US005435718A

United States Patent [19]

Briggs

[11] Patent Number: 5,435,718

[45] Date of Patent: Jul. 25, 1995

[54] FUEL SHUT-OFF SYSTEM FOR FUEL-BURNING HEATER

[75] Inventor: Eugene C. Briggs, Bowling Green, Ky.

[73] Assignee: Black Gold Corporation, Nashville, Tenn.

[21] Appl. No.: 137,712

[22] Filed: Oct. 15, 1993

Related U.S. Application Data

[63] Continuation-in-part of Ser. No. 970,932, Nov. 2, 1992.

[51] Int. Cl.[6] ..... F23N 1/00

[52] U.S. Cl. ..... 431/90

[58] Field of Search ..... 431/31, 38, 90, 121; 137/114; 239/570

[56] References Cited

U.S. PATENT DOCUMENTS

| | | | |
|---|---|---|---|
| 1,853,863 | 4/1932 | Hornbruch | 137/114 |
| 3,269,448 | 8/1966 | Martin | 431/90 |
| 3,269,450 | 8/1966 | Licata et al. | 431/90 |
| 3,299,940 | 1/1967 | Phillips et al. | 137/114 |
| 4,955,359 | 9/1990 | Briggs et al. | 126/110 R |

*Primary Examiner*—Carroll B. Dority
*Attorney, Agent, or Firm*—Michael E. McKee

[57] ABSTRACT

An oil-burning furnace including a combustion zone, an air passageway through which air is routed to the combustion zone, an air compressor for moving the air through the combustion zone in a pressurized condition and an oil passageway through which oil is routed to the combustion zone for burning in the presence of air utilizes a shutoff assembly for positively shutting of the flow of oil through the fuel passageway upon shutdown of the furnace operation. The shutoff assembly is associated with the air passageway and is actuated in response to a drop in the pressure of air in the air passageway below a preselected level. Thus, the actuation of the shutoff means is coordinated with the de-energizing of the air compressor. In addition, the oil passageway is adapted to shut off the flow of oil at a location along the passageway which is disposed in relatively close proximity to the combustion zone.

21 Claims, 4 Drawing Sheets

FUEL SHUT-OFF SYSTEM FOR FUEL-BURNING HEATER

This application is a continuation-in-part of application Ser. No. 07/970,932, filed Nov. 2, 1992 and entitled FUEL, DELIVERY SYSTEM FOR FUEL-BURNING HEATER AND ASSOCIATED COMPONENTS, whose disclosure is incorporated herein by reference.

BACKGROUND OF THE INVENTION

This invention relates generally to furnaces which utilize fuel oil or waste oil as fuel and relates, more particularly, to the means through which fuel and air are delivered to the combustion zone of such a furnace for burning.

Prior art furnaces which burn fuel oil or waste oil in a combustion zone commonly include a nozzle block assembly utilizing an atomizing nozzle through which air and oil are conducted into the combustion zone for burning and a fuel pump and air compressor for delivering fuel and air, respectively, to the nozzle. It is common in such furnaces that upon shutdown of furnace operation, fuel is permitted to migrate into and drip from the nozzle into the combustion zone or onto the flame retention head located within the zone where deposits may build up.

Accordingly, it is an object of the present invention to provide a new and improved system for a furnace of the aforedescribed class which prevents the undesirable flow of fuel through the nozzle upon shutdown of furnace operation.

Another object of the present invention is to provide such a system which positively shuts off the flow of fuel through the nozzle upon shutdown of the furnace.

Still another object of the present invention is to provide such a system which is uncomplicated in structure and effective in operation.

SUMMARY OF THE INVENTION

This invention resides in a system for use in a fuel-burning furnace including a combustion zone, an air passageway through which air is routed to the combustion zone, means for moving the air through the air passageway in a pressurized condition and a fuel passageway through which fuel is routed to the combustion zone for burning in the presence of air.

The system comprises shutoff means associated with the fuel passageway for shutting off the flow of fuel therethrough in response to a drop in the internal pressure of the air passageway below a preselected level.

DETAILED DESCRIPTION OF THE ILLUSTRATED EMBODIMENT

Figure 1:
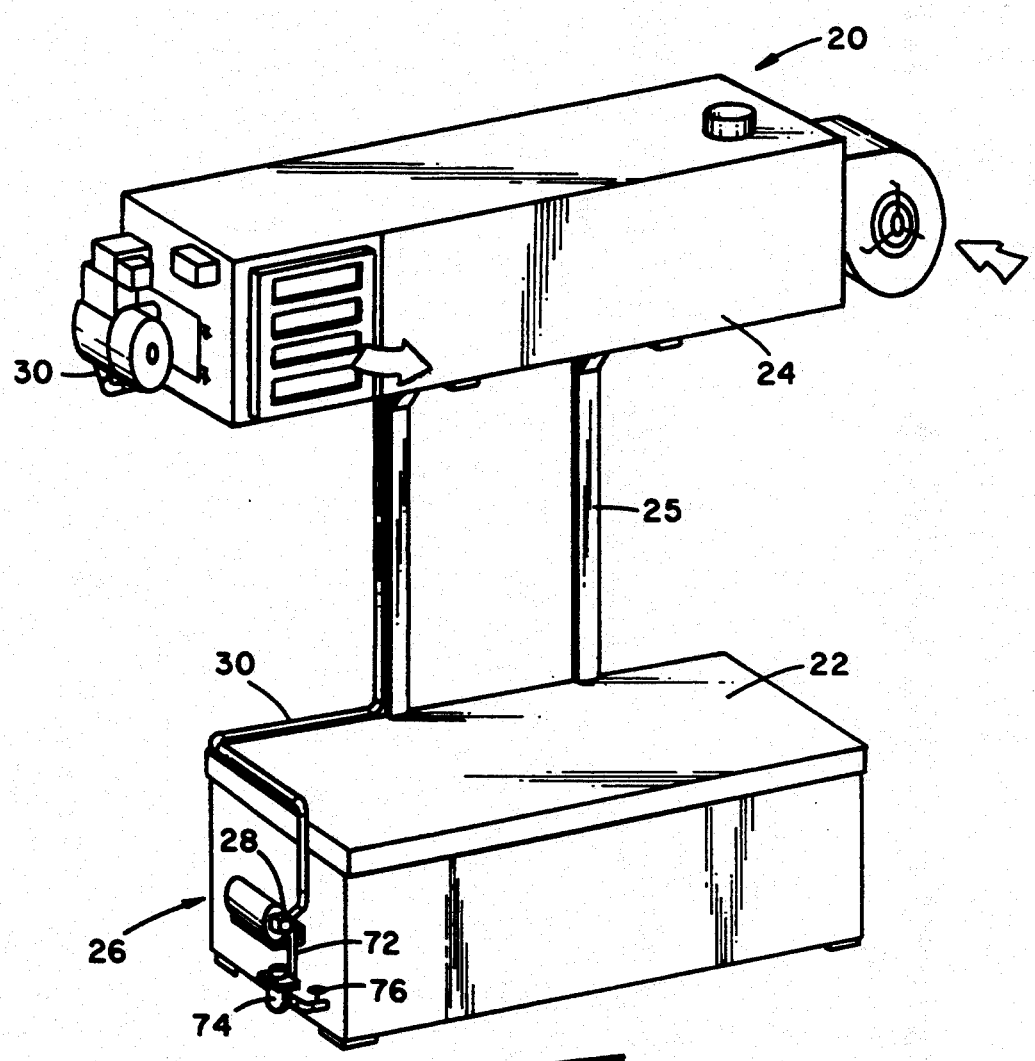
FIG. 1 is a perspective view of a waste oil-burning heating system within which features of the present invention are incorporated.

Turning now to the drawings in greater detail, there is shown in FIG. 1 a heating system 20 including an oil-burning furnace 24 within which waste oil is burned and a reservoir tank 22 within which oil is stored until burned in the furnace 24. The furnace 24 is supported in an elevated condition above the reservoir 22 by means of a stand 25. The system 20 also includes a fuel delivery system, generally indicated 26, including a pump assembly 28 disposed adjacent the reservoir 22 and a fuel line 30 joined between the reservoir 22 and the furnace 24. During operation of the heating system 20, oil is pumped through the fuel line 30 by the pump assembly 28 from the reservoir 22 to the furnace 24 at a metered, substantially constant flow rate.

Figure 2:
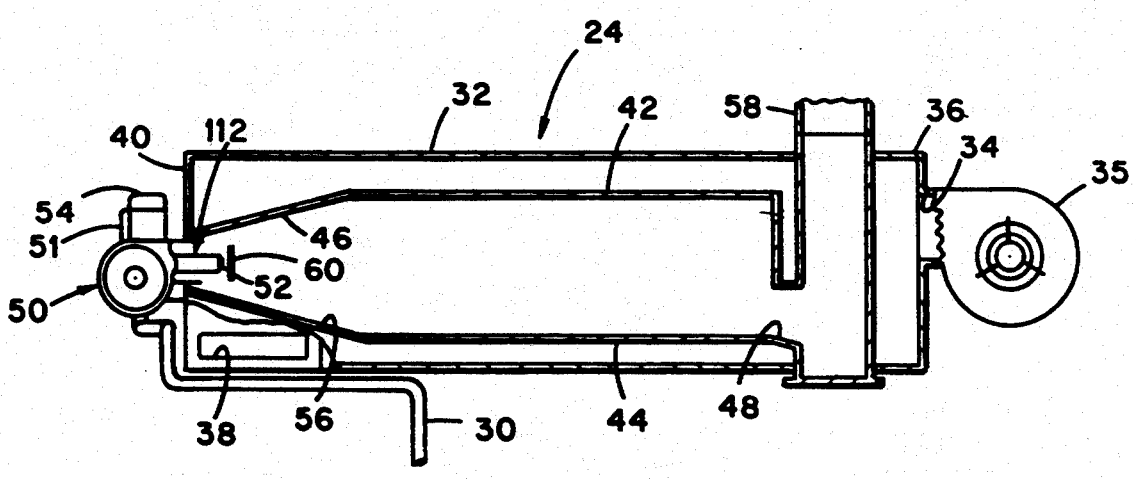
FIG. 2 is an elevational view, shown partially in longitudinal section, of the furnace of the FIG. 1 system.

As best shown in FIG. 2, the furnace includes an elongated housing 32 having an air intake 34 adjacent one end 36 of the housing 32 and a discharge vent 38 adjacent the other end 40 of the housing 32, a circulating air blower 35 supported adjacent the intake end 36 of the housing 32, and a heat exchanger 42 having an elongated hollow body 44 supported axially along the housing 32. The heat exchanger body 44 includes an inlet end 46 through which oil and air are introduced into the heat exchanger body 44 for burning and an opposite outlet end 48. The furnace 24 also includes a burner assembly 50 supported by the housing 32 adjacent the vent end 40 for burning the oil within the heat exchanger 42 and an oil burner blower 51 for moving the products of combustion from the inlet end 46 of the heat exchanger body 44 toward the outlet end 48. The burner assembly 50 also includes an atomizing nozzle 52 for directing oil and compressed air into the heat exchanger body 44 and an air compressor 54 for delivering compressed air to the nozzle 52. An ignition transformer including an electrode 55 (best shown in FIG. 4) is supported adjacent the nozzle 52 for igniting the burn, and a flame retention head 60 is supported forwardly of the nozzle 52 for maintaining the flame of the burn adjacent the nozzle 52.

During use of the furnace 24, the oil which is introduced within the heat exchanger body 44 through the nozzle 52 is burned within a combustion zone 56 provided by the heat exchanger 42 so that the outer surface of the heat exchanger 42 is heated by the flame and attending combustion products moving through the heat exchanger body 42. The products of combustion are subsequently forced out of the heat exchanger 42 by way of the heat exchanger body 44. Air, such as room air, desired to be heated by the furnace 24 is forced by the circulating blower 35 into the housing 32 through the intake end 36 so that the air flows between the outer surface of the heat exchanger 42 and the walls of the housing 32. As air is moved around the heat exchanger 42, it absorbs heat therefrom and subsequently exits the housing 32 through the discharge vent 38 in a heated condition. For a more detailed description of the structure and operation of the furnace 24, reference can be had to U.S. Pat. No. 4,955,359, the disclosure of which is incorporated herein by reference.

Figure 3:
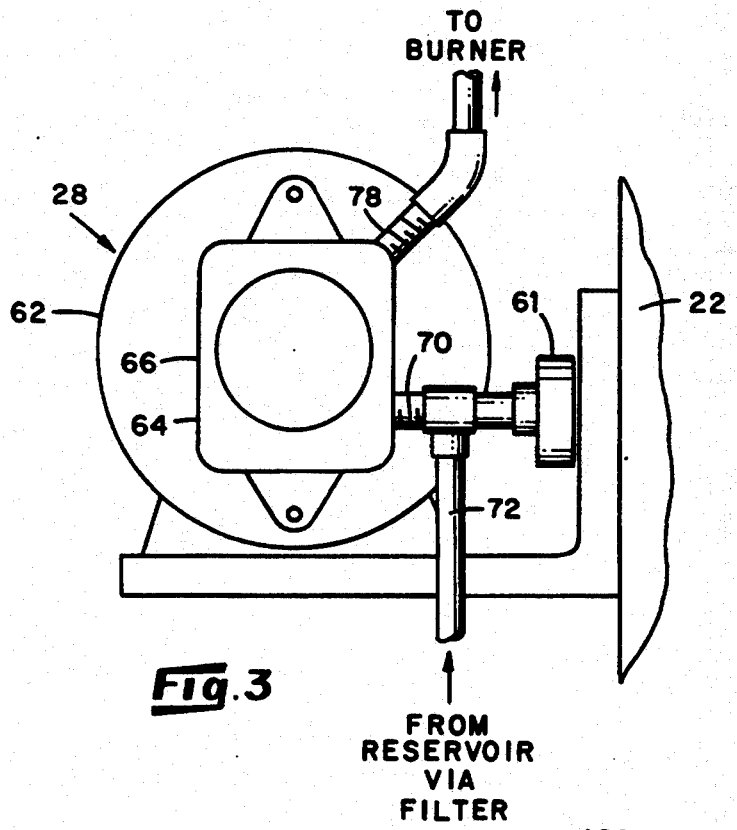
FIG. 3 is a side elevational view of a fragment of the FIG. 1 arrangement as seen generally from the front in FIG. 1.

With reference to FIGS. 1 and 3, the pump assembly 28 of the fuel delivery system 26 includes a motor 62 and a pump 64 positioned at one end of the motor 62. The pump 64 includes a housing 66 and an internal rotor (not shown) which is connected to the shaft of the motor 62, so that by energizing the motor 62, the rotor is rotated by the motor shaft within the housing 66. As best shown in FIG. 3, the pump housing 66 includes an inlet port 70 joined in flow communication with the interior of the reservoir 22 by means of a conduit 72 joined at one end to the reservoir 22 and joined at its opposite end to the pump housing 66. If desired, a filter assembly 74 (FIG. 1) and shut-off valve 76 can be positioned in-line with the conduit 72 for filtering the oil drawn from the reservoir 22 by the pump 64 and providing means for shutting off the oil flow through the conduit 72, and a vacuum gauge 61 (FIG. 3) can be connected adjacent the inlet port 70. The pump housing 66 also includes an inlet port 78 through which oil exits the housing 66.

A detailed description of the pump assembly 28 is set forth in patent application Ser. No. 07/970,932, filed Nov. 2, 1992, now U.S. Pat. No. 5,372,484 and whose disclosure is incorporated herein by reference, so that a more detailed description herein is not believed to be necessary. Suffice it to say that the pump 64 is well-suited for delivering oil to the furnace at a predetermined metered, substantially constant flow rate even though the oil of the reservoir 22 may possess a weight within a relatively broad range of fuel weights or a viscosity within a relatively broad range of viscosities. The capacity of the pump 64 to pump oils of different weights or varying viscosities at substantially the same metered rate can be readily appreciated in view of the fact that the waste oil contained within the reservoir 22 could possess any weight ranging from a relatively light weight to a relatively heavy weight. Therefore, regardless of the weight of the oil contained within the reservoir 22, the oil pumped through the furnace nozzle 52 (FIG. 2) for burning within the combustion zone 56 of the furnace 24 is delivered to the combustion zone 56 at substantially the same, constant metered rate so that the pressure of the air delivered to the combustion zone by the compressor 54 is less critical and the furnace 24 can be operated efficiently. Accordingly, the pump 64 circumvents the need for fuel and air pressure gauges which would commonly be used to continuously monitor the fuel and air delivery systems. Still further, the enhanced efficiency of the furnace 24 due to the pump 64 reduces soot build-up within the heat exchanger 42 and promotes a cleaner burning of the air/fuel mixture.

Figure 4:
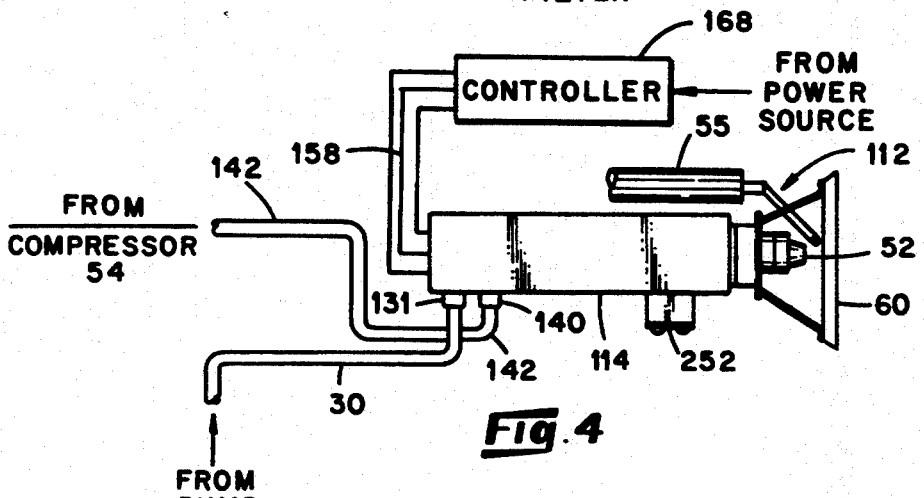
FIG. 4 is a fragmentary view illustrating schematically the nozzle assembly of the FIG. 1 heating system.
Figure 5:
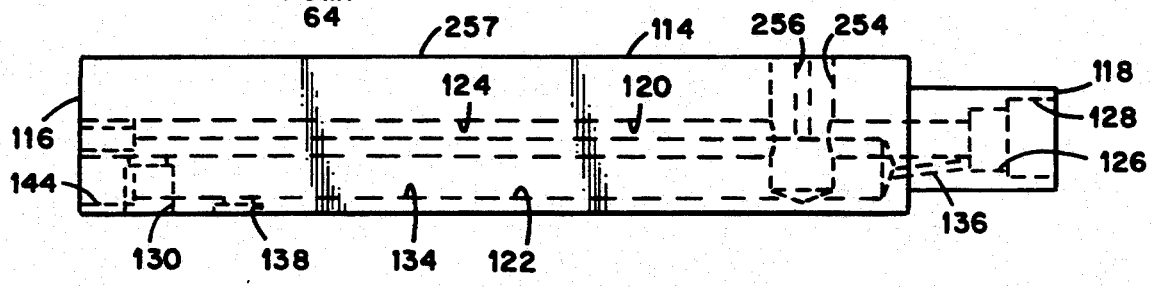
FIG. 5 is a side elevational view of the block of the nozzle assembly of FIG. 4, shown inverted from the FIG. 4 view.

With reference to FIG. 4, the furnace nozzle 52 is one component of a nozzle block assembly 112 supported adjacent the combustion zone 56 of the furnace 24. The nozzle block assembly 112 of the depicted furnace 24 includes a body, or block 114, constructed of aluminum or other suitable material, within which the nozzle 52 is mounted and through which oil and air from the pump 64 and compressor 54, respectively, are routed to the nozzle 52. As best shown in FIG. 5, the block 114 includes two opposite ends 116, 118 ,and an oil passageway 120 and an air passageway 122. The oil passageway 120 is provided, in part, by a bore 124 extending through the block 114 along a path offset slightly to one side of the longitudinal axis of the block 114 from the block end 116 to a location adjacent the opposite block end 118. At the opposite end 118, an enlarged bore section 126 communicates with the central bore 124 and is internally-threaded at the bore entrance 128 adjacent the block end 118. A section of the oil passageway 120 is provided by an access bore 130 formed in one side of the block 114 so as to communicate with the central bore 124. Provided at the entrance of the access bore 130 is an internally-threaded section for threadably receiving a fitting 131 (FIG. 4) used for joining the fuel line 30 to the nozzle block 114. The entrance of the central bore 124 adjacent the block end 116 is closed by a plug 132 (FIG. 6) secured therein.

With reference again to FIG. 5, the air passageway 122 of the block 114 is provided, in part, by a longitudinal bore 134 extending from the block end 116 to a location adjacent the opposite block end 118 and a smaller bore 135 providing communication between the bore 134 and the enlarged bore section 126. An access bore 138 is formed in one side of the block 114 so as to communicate with the longitudinal bore 134, and the entrance of the access bore 138 is provided with an internally-threaded section for threadably receiving a fitting 140 (FIG. 4) used for joining the air conduit, indicated 142 in FIG. 4, to the nozzle block 114. The entrance of the longitudinal bore 134 adjacent the block end 116 is provided with a threaded entrance 144 for accepting and attaching an electric heater element 152 (FIG. 6) inserted therein.

Figure 6:
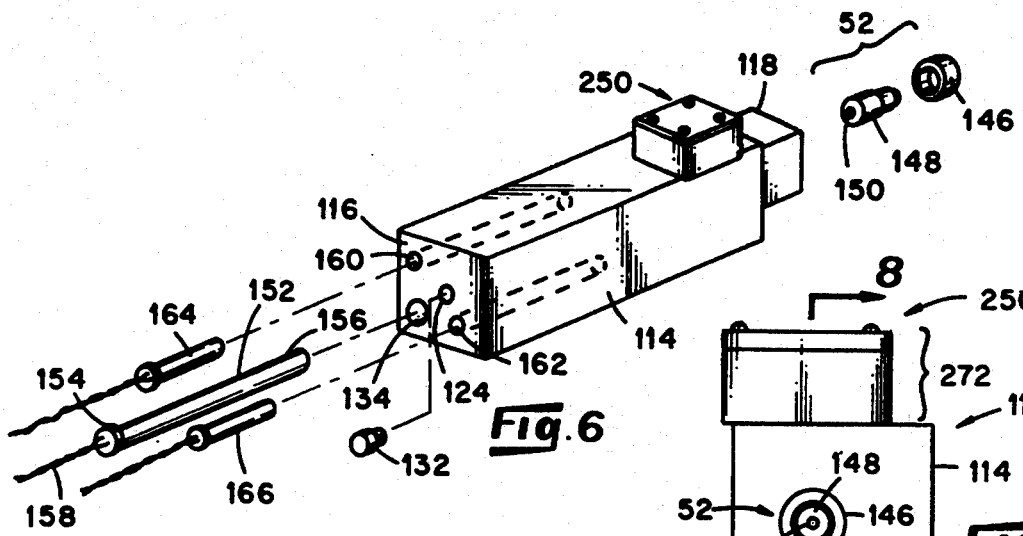
FIG. 6 is a perspective view of the nozzle assembly of FIG. 4, shown exploded.
Figure 6A:
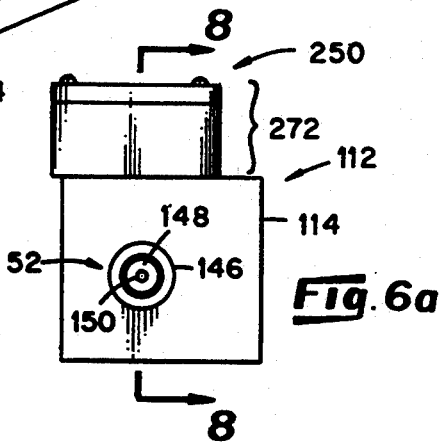
FIG. 6*a* is an end elevation view of the nozzle assembly of FIG. 6 as seen generally from the right in FIG. 6.

As shown in FIG. 6 and 6a, the nozzle 52 is a multipiece unit having a securement member 146 for threadably securing the nozzle 52 within the entrance 128 (FIG. 5) of the bore section 126 of the block 114 and a central member 148 retainably positioned within the bore entrance 28 by the securement member 146 and which includes a central through-opening 150. When the nozzle 52 is secured within the block 114 and the furnace 24 is in operation, the oil flowing through the oil passageway 120 (FIG. 5) exits the nozzle 52 through the through-opening 150, and air flowing through the air passageway 122 (FIG. 6) enters the enlarged bore section 126 and exits the nozzle 52 through suitable passageways provided about the through-opening 150 of the central member 148.

Figure 7:
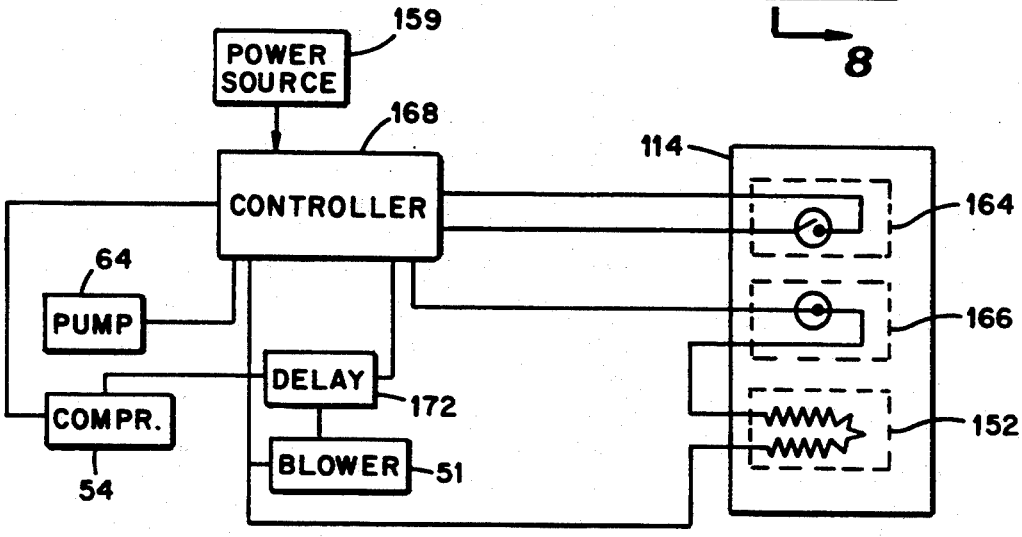
FIG. 7 is a schematic view illustrating in block diagram form the wiring of the FIG. 1 heater system.

The nozzle block assembly 112 also includes the immersion electric heater element 152, introduced earlier, secured within the longitudinal bore 134 of the air passageway 122. As best shown in FIG. 6, the heater element 152 includes a base 154 adapted to be sealingly secured within the threaded entrance 144 of the longitudinal bore 134 and an elongated resistance element 156 joined to so as to extend from the base 154. When secured within the longitudinal bore 134, the resistance element 156 extends for a substantial distance into the bore 134 and its outer surface is spaced from the interior walls of the bore 134. During heater operation, air pumped by the compressor 54 through the air passageway 122 flows between the walls of the bore 134 and the surface of the element 156 so as to contact and absorb heat from the element 156. The air thereafter flows out of the nozzle 52 in a heated condition where it is used for burning with the atomized oil in the combustion zone 56 of the furnace 24. Thus, the depicted nozzle block assembly 112 directly heats air, rather than oil, routed through the block to facilitate the burn adjacent the nozzle 52 and circumvents problems, e.g. carbonization or build-up of a varnish, commonly attending the preheating of oil. Power to the element 156 is provided through wires 158 extending through the base 154 and connected to a power source 159 (FIG. 7). The heater element 152 of the depicted nozzle block assembly 112 is rated at about 400 watts and heats the air moving through the air passageway 122 to about 400° F.

With reference still to FIG. 6, the nozzle block 114 also includes two bores 160, 162 extending about midway through the block 114 from the block end 116. Positioned within the bores 160, 162 are two temperature control thermostats 164, 166 positioned in heat exchange relationship with the block 114 for monitoring the temperature thereof in a manner described herein. Each thermostat 164 or 166 can be secured within a corresponding bore 160 or 1152 with a plug of silicone rubber adhesive or another suitable material. The thermostats 164,166 are part of a control system within the furnace 24 which permits the metering pump 64 to operate only if the temperature of the block 114 is within a preselected temperature range. In this connection and with reference to FIG. 7, this control system includes a controller 168 including a control circuit within which the electric heater element 152 and thermostats 164 and 166 are wired. One thermostat 164 is normally-opened and adapted to close when the temperature of the block 114 is raised to about 160° F. The other thermostat 166 is normally-closed and adapted to open if the temperature of the block 114 rises to about 200° C. so as to shut off power to the element 152.

Upon energizing the furnace 24 through, for example, a room thermostat, power is supplied to the heater element 152 so that the nozzle block 114 is heated by the element 152 (primarily by radiant heat emitted therefrom), but the thermostat 164 prevents components, such as the metering pump 64 and the ignition transformer, as well as the air compressor 54 and burner blower 51, from operating until the temperature of the block 114 reaches about 160° F. When the block 114 attains the temperature of about 160° F., the thermostat 164 closes and the pump 64, burner blower 51 and air compressor 54 are switched ON. Such a feature ensures that air routed through the block from the compressor 54 is preheated by the element 152 from the outset of compressor operation. The thermostat 166, on the other hand, acts to prevent the overheating of the block 114 and, accordingly, shuts off power to the element 152 if the block temperature exceeds about 206° F. With reference still to FIG. 7, the furnace control circuit inherently causes a time delay for continuing the operation of the burner blower 51, ignition transformer, pump and compressor 54 for a short period of time following de-energization of the element 152 to cool the nozzle block 114 following a burn cycle of the furnace operation.

The furnace 24 also includes means, generally indicated 250 in FIG. 6, for positively shutting off the flow of oil through the nozzle 52 upon shutdown of the furnace operation. As will be apparent herein, the shutoff means 250 is associated with the air passageway 122 to effect a positive shutoff of the flow of oil through the oil passageway 120 when the internal pressure of the air passageway 122 falls below a predetermined level.

Figure 10:
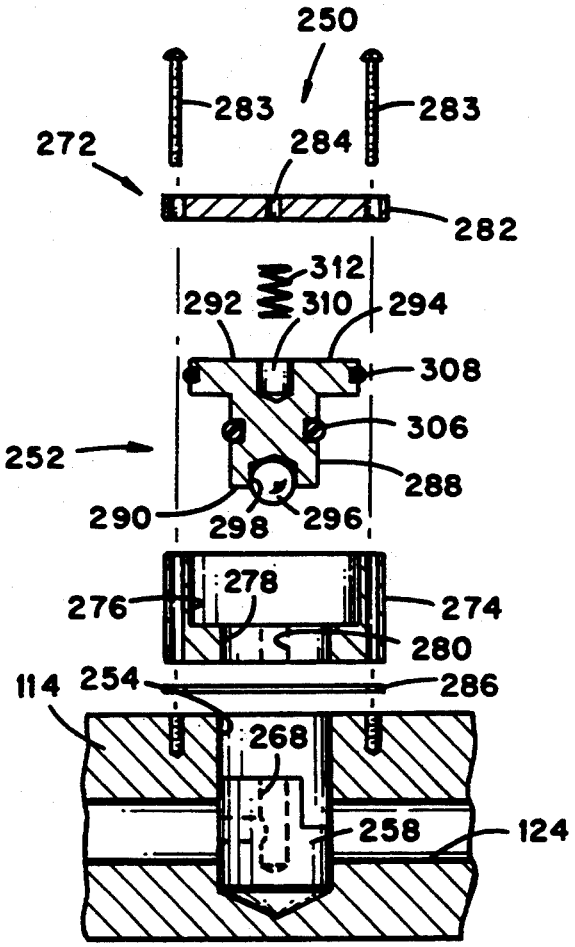
FIG. 10 is a view similar to that of FIG. 9 illustrating other components of the shutoff means of the FIG. 8 assembly, shown exploded.
Figure 11:
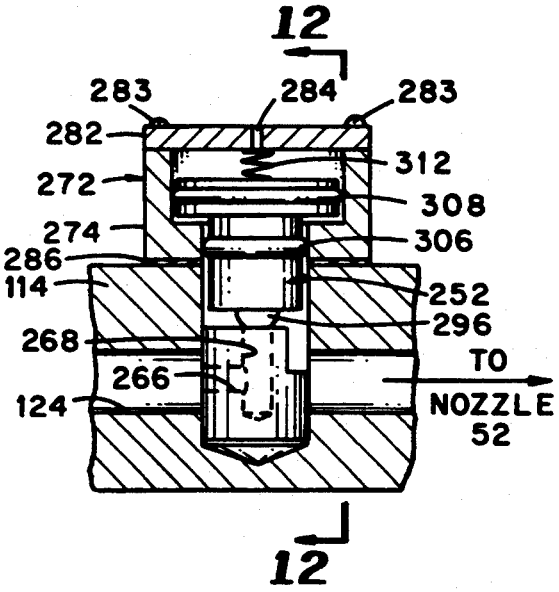
FIG. 11 is a view similar to that of FIG. 10 illustrating the components of the shutoff means when in an assembled condition.
Figure 12:
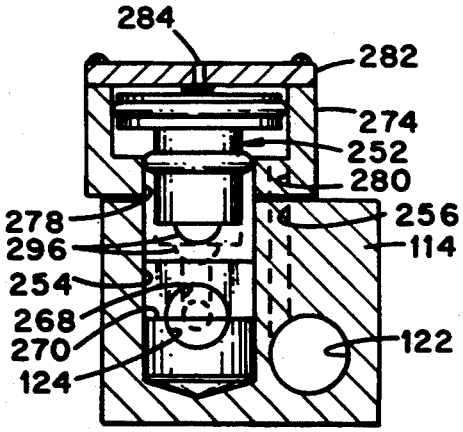
FIG. 12 is a cross-sectional view of taken about along line 12—12 of FIG. 11.

In the depicted embodiment 24 and with reference to FIGS. 10–12, the shutoff means 250 includes a plunger assembly 252 which is mounted within the nozzle block 114 adjacent the block end 118 for movement between a position at which the flow of oil through the oil passageway 120 is shut off and a second position which permits the flow of oil through the passageway 120 to the nozzle 52. In this connection and as best viewed in FIG. 5, the nozzle block body 250 includes a bore 254 formed in one side, indicated 257, of the nozzle block body 114 and adjacent the block end 118 so as to extend through the oil passageway 120, and another, somewhat smaller bore 256 is formed adjacent and substantially parallel to the bore 254 so that the bore 256 opens at one end into the bore portion 134 of the air passageway 122 and opens at its upper end out of the side 257 of the block 114.

Figure 8:
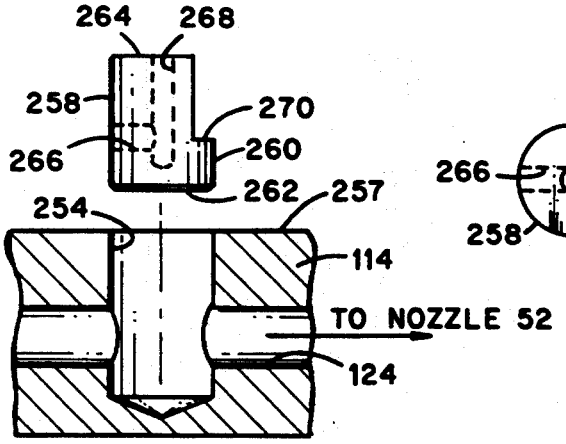
FIG. 8 is a fragmentary cross-sectional view of the nozzle block assembly as viewed about along line 8—8 of FIG. 6*a*, shown exploded.
Figure 9:
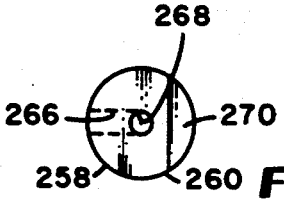
FIG. 9 is a plan view of an orifice member of the shutoff means of the FIG. 8 assembly as seen generally from above in FIG. 8.

Positioned within the bore 254 is a valve orifice member 258, best shown in FIGS. 8 and 9, comprised of a cylindrically-surfaced body 260 sized to be sealingly received by, i.e. press-fitted within, the bore 254 and including two opposite ends 262, 264. A first bore 266 opens out of one side of the body 260 and a second bore 268 extends axially along the body 260 from the body end 264 and joins the first bore 268. In addition, a cutout 270 is formed, as shown in FIGS. 8 and 9, in the side of the body 260 opposite the first bore 266, and the body 260 is arranged within the nozzle block bore 250 so that the first bore 266 is directed toward the nozzle block end 116 and is substantially aligned with the longitudinal axis of the central bore 124 of the nozzle block body 114.

With reference again to FIG. 10, there is associated with the plunger assembly 252 a valve body assembly 272 having a top plate 282 and a body 274 having a circular recess 276 opening out of one side of the body 274 and two bores 278, 280 (FIGS. 10 and 12) extending between the base of the recess 276 and the opposite side (or the lower side as shown) of the body 274. One bore 278 is positioned substantially centrally of the recess 276 and is about the same size as that of the bore 254, and the other bore 280 is spaced to one side of and is slightly smaller in size than that of the bore 254. The top plate 282 is adapted to be secured across the opening of the recess 276 with screws 283 and includes a central through-opening 284 whose purpose will become apparent herein.

The valve body assembly 274 is securable against the nozzle block side 257 (with the screws 283) as shown in FIGS. 11 and 12 so that the bore 278 is aligned with the nozzle body bore 254 and the bore 280 is aligned with the nozzle body bore 256. Preferably, a gasket 286 (FIG. 10) is secured between the body 274 and the nozzle block side 257.

The plunger assembly 252 includes an elongated body portion 288 having two opposite ends 290, 292 and an elongated, substantially platen-like head portion 294 fixedly joined to the body portion end 292. An elastomeric ball 296, constructed for example of a synthetic rubber material available under the trade designation Buna "N" from Minor Rubber Co. of Bloomfield, N.J., is secured to the end 290 of the elongated body portion 288 so as to be positionable in registry with the opening of the bore 268 of the orifice member 258. To secure the ball 296 to the body portion 288 of the plunger assembly 252, a bore 294 is formed in the end 290 of the body portion 288, and the ball 296 is sized to be snugly accepted by so as to be secured within the bore 298. In addition, each of the body portion 288 and head portion 294 includes an annular groove about its mid-section for acceptance of an 0-ring 306 or 308 thereby. The body portion 288 also includes a circular recess 310 opening out of the upper surface of the head portion for a reason which will be apparent herein.

With the top plate 282 removed from the body 274, the plunger assembly 252 is positioned within the valve assembly 272 by inserting the assembly 252 ball-end-first into the valve assembly body 274 so that the body portion 288 is slidably received by the aligned bores 278,254 and the head portion 294 is slidably received by the circular recess 276. Each of the body portion 288 and head portion 294 is sized to be closely received by the corresponding one of the aligned bores 278, 258 or recess 276 so that the 0-rings 306, 308 seal the space between opposing surfaces. When fully positioned within the nozzle block 114 as shown in FIG. 11, the ball 296 is positioned across so as to sealably close the bore 268, and the head portion 294 is positioned adjacent the base of the recess 276. To complete the assembly of the shutoff means 252, a small compression spring 312 is positioned within the recess 310 provided in the plunger body portion 288, and the top plate 282 is secured over the base of the valve assembly 272 with the screws 283 so that the spring 312 is maintained in a partially compressed condition between the head portion 294 and the underside of the plate 282.

During operation of the shutoff means 252, the plunger assembly 252 is moveable between a first position as shown in FIG. 11 at which the ball 296 overlies so as to seal the bore 268 and a second position as shown in solid lines in FIG. 12 at which the ball 296 is spaced above the bore 268. Thus, when the plunger assembly 252 is situated so as to seal the bore 268, section a of the oil passageway 120, i.e. the insert member bores 266 and 268, is obstructed by the plunger assembly 252. As the plunger assembly 252 is moved between the aforedescribed first and second positions, the compression spring 312 continually urges the plunger assembly 252 from the second position toward the first position.

It follows that as long as the ball 296 is spaced above the bore 268 as shown in solid lines in FIG. 12, oil is permitted to flow along the oil passageway bore 124 as the oil moves in sequence through the bores 266, 268 of the orifice member 258 and then across the upper end 264 of the orifice member 258 and downwardly through the spacing provided between the surfaces of the cutout 270 and the bore 254. Conversely, if the ball 292 is positioned across so as to close the bore 268, the flow of oil to the nozzle 52 is shut off.

It is a feature of the shutoff means 250 that the plunger 252 is moved from the first, or FIG. 11, position to the second, or FIG. 12 solid-line, position in response to the raising of the pressure of the air flowing through the air passageway 122 above a preselected level, and the plunger 252 is permitted to return from the second position to the first position under the influence of the spring 312 when the air pressure in the air passageway 122 falls below the preselected level. To this end, the recess 276 provided in the valve body assembly 272 acts as a cylinder, and the head portion 294 of the plunger 252 acts as a piston which moves along the recess 276 in response to the sensed pressure of the air in the air passageway 122 by way of the aligned bores 256, 280 (FIG. 12). The central through-opening 284 defined in the top plate 282 provides a vent through which the spacing of the recess 276 situated above the plunger head portion 294 communicates with the surrounding atmosphere.

It follows from the foregoing that the actuation of the plunger 252 along the length of the recess 276 is coordinated with the operation of the furnace air compressor 54 which, during furnace operation, is adapted to raise the pressure of the air within the air passageway 122 and upstream of the nozzle 52 to a pressure level sufficient to lift the plunger 252 along the length of the recess 276 to the second, or FIG. 12 solid-line, position against the biasing force of the spring 312. When power to the air compressor 54 is shut off, as would occur upon furnace shutdown, the air pressure within the passageway 122 falls to atmospheric so that the spring 312 returns the plunger 252 along the recess 276 to its first, or FIG. 11, position at which the bore 268 is sealed shut by the ball 296.

In the depicted furnace 20, the spring 312 is sized to permit the plunger 252 to be lifted to the FIG. 12 solid-line position when the air pressure within the passageway 122 exceeds about 10 psig, a pressure level to which the air compressor 54 is capable of exceeding during furnace operation. Along these lines, the oil pump assembly 28 is adapted to move the oil through the oil passageway 120 at a substantially constant, relatively slow flow rate so that the oil pump would not, under its own power, raise the oil pressure within the oil passageway 120 to a pressure sufficient to lift the plunger 252 (or ball 296) from the bore 268 in opposition to the biasing force of the spring 312. Preferably, a pressure differential between the air passageway 122 and the oil passageway 120 of between about 2.0 and 7.0 psi is maintained during furnace operation.

The shutoff means 250 is advantageous in that it provides a positive shut off of the flow of oil through the oil passageway 120 upon shutdown of the furnace operation. In other words, the shutoff means 250 blocks off the oil passageway 120 following furnace shut down so that oil is thereby prevented from flowing along the oil passageway 120 and past the orifice member 258. This blocking off of the oil passageway 120 reduces the chances that oil will drip or seep from the nozzle 52 following furnace shutdown in a manner which could lead to an undesirable build up of deposits within the combustion zone 56 or onto the flame retention head 60. Still further, upon the shutting off of power to the air compressor 54 and to the oil pump assembly 28, the pressure of the air within the air passageway 122 falls more rapidly than does the pressure of the oil within the oil passageway 120 so that upon furnace shutdown, the plunger 252, or ball 296, moves rapidly to a seated condition upon the bore 268. This rapid movement of the plunger 252 to a seated condition over the bore 268 provides a sudden shutting off of the bore 268 and is advantageous in this respect.

The shutoff means 250 provides a further advantage in that the plunger 252 and insert member bore 268 cooperate to shut off the oil passageway 120 at a location proximate, e.g. within about 2.0 inches, from the nozzle 52. Therefore, upon furnace shutdown, there exists very little oil in the passageway 120 between the orifice member 258 and the nozzle 52 which could migrate or otherwise seep through the nozzle 52. Furthermore, it is believed that the downward movement of the head portion 296 within the valve body 274 (under the influence of the spring 312) upon furnace shutdown effects a purging (by a pushing out) of an amount of oil from the oil passageway 120 immediately upstream of the nozzle 52 to further reduce the amount of oil which remains in the passageway 120.

It follows from the foregoing that a system has been described which accomplishes the intended objectives and purposes of the invention. More specifically, shutoff means 250 has been described for use with a fuel-burning furnace 20 which positively shuts off the flow of oil to the nozzle 52 upon shutdown of the furnace 20 in a manner which reduces any likelihood of undesirable seepage or dripping of fuel from the nozzle 52 following shutdown.

It will be understood that numerous modifications and substitutions can be had to the aforedescribed embodiments without departing from the spirit of the invention. For example, although the aforedescribed shutoff means 252 has been shown and described as including a compression spring 312 for biasing the plunger 250 from the FIG. 12 solid-line position to the FIG. 11 position, shutoff means in accordance with the broader aspects of the invention may utilize an elastomeric member interposed between the top plate 282 and the plunger 252. Accordingly, the aforedescribed embodiment is intended for the purpose of illustration and not as limitation.

I claim:

1. In a liquid fuel-burning furnace including a combustion zone, an air passageway through which air is routed toward the combustion zone, means for moving the air through the air passageway in a pressurized condition, a fuel passageway through which liquid fuel is routed toward the combustion zone for burning in the presence of air and a nozzle associated with the fuel and air passageways through which the liquid fuel is conducted from the fuel passageway into the combustion zone in an atomized condition and through which air is conducted from the air passageway into the combustion zone with the atomized fuel, the improvement comprising:

shutoff means associated with the fuel passageway and responsive to the internal pressure of the air passageway for permitting the liquid fuel to flow substantially unrestricted through the fuel passageway when the pressure of the air passageway is maintained at or above a preselected level and for shutting off the fuel passageway so as to permit no fuel to flow therethrough in response to a drop in the internal pressure of the air passageway below the preselected level;

the shutoff means including means for obstructing the fuel passageway and thereby preventing the flow of liquid fuel therethrough when the internal pressure of the air passageway falls below the preselected level; and the obstructing means is adapted to obstruct the fuel passageway at a location upstream of and adjacent the nozzle to reduce the likelihood that liquid fuel will drip from the nozzle upon shutdown of the furnace.

2. The improvement as defined in claim 1 wherein the obstructing means is adapted to obstruct the fuel passageway at a location disposed within about 2.0 inches upstream from the nozzle.

3. The improvement as defined in claim 1 wherein the obstructing means of the shutoff means includes a plunger which is supported for movement relative to the fuel passageway between one position at which the fuel is permitted to flow through the fuel passageway and another position at which the flow of fuel through the fuel passageway is blocked off by the plunger.

4. The improvement as defined in claim 3 wherein the plunger is cooperable with the air passageway so that the plunger is moved between the one position and the another position as the internal pressure of the air passageway rises to and falls below the preselected level.

5. The improvement as defined in claim 3 wherein the fuel passageway is provided with an open-ended bore through which fuel is routed as it is moved through the fuel passageway, and the plunger is cooperable with the bore so that as the plunger is moved between the one position and the another position, the open end of the bore is closed off and opened by the plunger.

6. The improvement as defined in claim 5 wherein the plunger includes an elastomeric body for moving into and out of sealing relationship with the open end of the bore as the plunger moves between the one position and the another position.

7. The improvement as defined in claim 3 wherein the shutoff means includes means for continually biasing the plunger from the one position to the another position so that in order for the plunger to be moved out of the another position, the force of the biasing means must be exceeded by the internal pressure of the air passageway.

8. The improvement as defined in claim 3 wherein the shutoff means includes means providing a cylindrical cavity having an interior which is in flow communication with the air passageway and the plunger is slidably positioned within the cavity interior for movement therealong in response to a change in the internal pressure of the air passageway.

9. The improvement as defined in claim 3 wherein the plunger is disposed along the fuel passageway adjacent the nozzle so that movement of the plunger from the one position to the another position shuts off the flow of fuel in the fuel passageway adjacent the nozzle.

10. The improvement as defined in claim 9 wherein the plunger is disposed along the fuel passageway so that movement of the plunger from the one position to the another position shuts off the flow of fuel in the fuel passageway within about 2.0 inches from the nozzle.

11. A system for shutting off the flow of liquid fuel to the nozzle of a liquid fuel-burning furnace which includes a combustion zone and a nozzle through which the liquid fuel is directed into the combustion zone in an atomized condition, means defining an air passageway through which air is conducted to the nozzle and into the combustion zone, and means defining a fuel passageway through which fuel is conducted to the nozzle and toward the combustion zone for burning in the presence of air, and means for moving the air through the nozzle in a compressed condition and means for pumping the fuel through the nozzle, the system comprising:

means associated with each of the air passageway and the fuel passageway and responsive to the pressure of air flowing through the air passageway for permitting the liquid fuel to flow substantially unrestricted through the fuel passageway when the pressure of the air is maintained at or above a preselected level and for positively shutting off the flow of fuel through the fuel passageway so as to permit no fuel to flow to the nozzle when the internal pressure of the air passageway falls below the predetermined level; and the shutoff means is adapted to obstruct the fuel passageway at a location therealong which is disposed upstream of and adjacent the nozzle to reduce the likelihood that liquid fuel will drip from the nozzle upon shutdown of the furnace.

12. The system as defined in claim 11 wherein the shutoff means includes a plunger which is supported for movement relative to the fuel passageway between one position at which the fuel is permitted to flow through the fuel passageway and another position at which the flow of fuel through the fuel passageway is blocked off by the plunger.

13. The system defined in claim 12 wherein the plunger is cooperable with the air passageway so that the plunger is moved between the one position and the another position as the internal pressure of the air passageway rises to and falls below the predetermined level.

14. In a liquid fuel-burning furnace including a combustion zone and a nozzle block assembly including a nozzle through which liquid fuel is directed into the combustion zone in an atomized condition, means defining an air passageway through which air is conducted to the nozzle and into the combustion zone, and means defining a fuel passageway through which liquid fuel is conducted to the nozzle and toward the combustion zone for burning in the presence of air, and means for moving the air through the nozzle in a compressed condition and means for pumping the fuel through the nozzle, the system comprising:

means associated with a nozzle block assembly and the air and fuel passageways defined therein and responsive to the internal pressure of the air passageway of the nozzle block assembly for shutting off the flow of liquid fuel to the nozzle so as to permit no fuel to flow thereto when the internal pressure of the air passageway falls below a preselected pressure and for permitting substantially unrestricted flow of the liquid fuel to the nozzle when the pressure of the air passageway is at or above the preselected pressure; and the shutoff means includes means for obstructing the fuel passageway and thereby preventing the flow of liquid flow therethrough when the internal pressure of the air passageway falls below the preselected pressure; and the obstructing means is adapted to obstruct the fuel passageway at a location therealong which is disposed upstream of and adjacent the nozzle to reduce the likelihood that liquid fuel will drip from the nozzle upon shutdown of the furnace.

15. The improvement as defined in claim 14 wherein the shutoff means includes a plunger which is supported within the nozzle block assembly for movement relative to the fuel passageway between one position at which the fuel is permitted to flow through the fuel passageway and another position at which the flow of fuel through the fuel passageway is blocked off by the plunger.

16. The improvement as defined in claim 15 wherein the plunger is cooperable with the air passageway defined in the nozzle block assembly so that the plunger is moved between the one position and the another position as the internal pressure of the air passageway rises to and falls below the preselected level.

17. The improvement as defined in claim 15 wherein the fuel passageway defined by the nozzle block assembly is provided with an open-ended bore through which fuel is routed as it is moved toward the nozzle, and the plunger is cooperable with the open-ended bore so that as the plunger is moved between the one position and the another position, the open end of the bore is closed off and opened by the plunger.

18. The improvement as defined in claim 15 wherein the shutoff means includes means associated with the nozzle block assembly providing a cylindrical cavity having an interior which is in flow communication with the air passageway defined by the nozzle block assembly and the plunger is slidably positioned within the cavity interior for movement therealong in response to a change in the internal pressure of the air passageway.

19. The improvement as defined in claim 5 wherein the shutoff means includes means providing a cylindrical cavity having an interior which is in flow communication with the air passageway and a longitudinal axis which is substantially parallel with that of the open-ended bore, and the plunger is slideably positioned in the cavity interior for movement therealong in a direction substantially parallel to the longitudinal axis of the open-ended bore in response to a change in the internal pressure of the air passageway.

20. The system as defined in claim 12 wherein the fuel passageway is provided with an open-ended bore through which fuel is routed as it is moved through the fuel passageway, and the plunger includes an elastomeric seal member which is cooperable with the bore so that as the plunger is moved between the one position and the another position, the open end of the bore is closed off and opened by the elastomeric seal member.

21. The improvement as defined in claim 17 wherein the shutoff means includes means associated with the nozzle block assembly providing a cylindrical cavity having an interior which is in flow communication with the air passageway defined by the nozzle block assembly and a longitudinal axis which is substantially parallel with that of the open-ended bore, and the plunger is slidably positioned in the cavity interior for movement therealong in a direction substantially parallel to the longitudinal axis of the open-ended bore in response to a change in the internal pressure of the air passageway.

* * * * *